US009138887B2

(12) United States Patent
Su

(10) Patent No.: US 9,138,887 B2
(45) Date of Patent: Sep. 22, 2015

(54) EXTENSION BAR

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 178 days.

(21) Appl. No.: 13/892,352

(22) Filed: May 13, 2013

(65) Prior Publication Data

US 2013/0336713 A1 Dec. 19, 2013

(30) Foreign Application Priority Data

Jun. 14, 2012 (TW) ..... 101121351 A

(51) Int. Cl.
*B25B 23/00* (2006.01)
*B25G 3/18* (2006.01)

(52) U.S. Cl.
CPC ..... *B25G 3/18* (2013.01); *Y10T 403/592* (2015.01)

(58) Field of Classification Search
CPC ..... Y10T 403/599; Y10T 403/592; Y10T 403/602; B25B 23/007; B25B 23/0035
USPC ..... 403/322.1, 322.2, 325, 327; 81/177.1, 81/177.2, 177.85
See application file for complete search history.

(56) References Cited

U.S. PATENT DOCUMENTS

| | | | | |
|---|---|---|---|---|
| 1,916,412 | A * | 7/1933 | Buchanan | 248/343 |
| 4,589,308 | A * | 5/1986 | Palm | 81/177.85 |
| 5,333,523 | A * | 8/1994 | Palm | 81/177.85 |
| 6,062,112 | A * | 5/2000 | Bonniot | 81/177.85 |
| 6,254,303 | B1 * | 7/2001 | Falat et al. | 403/348 |
| 7,895,924 | B2 * | 3/2011 | Hsieh | 81/177.85 |
| 8,070,377 | B2 | 12/2011 | Wang | |
| 8,146,461 | B1 * | 4/2012 | Su | 81/177.85 |
| 8,424,423 | B2 * | 4/2013 | Su | 81/177.85 |
| 2001/0009632 | A1 * | 7/2001 | Cross | 403/322.2 |
| 2005/0145078 | A1 * | 7/2005 | Chuan | 81/177.85 |
| 2007/0163406 | A1 * | 7/2007 | Liu | 81/177.85 |
| 2007/0189847 | A1 * | 8/2007 | Lee | 403/322.1 |
| 2008/0247814 | A1 * | 10/2008 | Hageman | 403/322.2 |
| 2009/0226248 | A1 * | 9/2009 | Wang | 403/322.2 |

* cited by examiner

*Primary Examiner* — Michael P Ferguson
*Assistant Examiner* — Jonathan Masinick
(74) *Attorney, Agent, or Firm* — Alan D. Kamrath; Kamrath IP Lawfirm, P.A.

(57) ABSTRACT

An extension bar includes a rod having an outer periphery thereof including a recess and a positioning track extended thereon. The recess defines a first contact section and a second contact section disposed after the first contact section longitudinally. A sleeve is slidably mounted on the rod and includes an orifice extended radially therethrough. A stopper is movably engaged with and disposed at a fixed predetermined position on the positioning track. A detent is engaged between the rod and the sleeve and movably engaged in the recess and the orifice. A biasing member is disposed between the sleeve and the stopper.

7 Claims, 6 Drawing Sheets

EXTENSION BAR

BACKGROUND OF THE INVENTION

1. Field of the Invention

The present invention relates to an extension bar and, particularly to an extension bar that is able to engage a driving member with a pneumatic tool securely, and also adapted to allow the driving member to be released therefrom in an easy manner.

2. Description of the Related Art

U.S. Pat. No. 8,070,377 shows a quick-release coupler including a rod having first and second sections. The first section includes an end for coupling with a pneumatic tool. The second section extends from the other end of the first section. A sleeve is slidably mounted around the rod and includes an end for releasably coupling a bit. The sleeve includes an axial bore having larger and smaller sections. The larger section has polygonal cross sections corresponding to polygonal cross sections of the first section. A radial bore is formed in the sleeve and in communication with the smaller section. A ball is moveably received in the radial bore and moveably received in a recess of the second section of the rod to releasably engage the sleeve with the bit. A spring is mounted in the larger section of the sleeve for biasing the sleeve towards the other end of the rod.

When the quick-release coupler is driven by a pneumatic tool, there exists a vibration, and such vibration can cause the sleeve to slide relative to the rod to a position in which a bit held in the quick-release coupler is inadvertently released. Additionally, when spring fatigue happens, the quick-release coupler is no longer able to hold the bit securely.

The present invention is, therefore, intended to obviate or at least alleviate the problems encountered in the prior art.

SUMMARY OF THE INVENTION

According to the present invention, an extension bar adapted to releasably engage a driving member with a pneumatic tool in a quick manner includes a rod, a sleeve, a stopper, a detent, and a biasing member. The rod has a first end and a second end opposite to the first end and adapted to engage with a pneumatic tool, with an outer periphery thereof including a recess and a positioning track extended thereon. The recess defines a first contact section and a second contact section disposed after the first contact section longitudinally. The sleeve is slidably mounted on the rod and has an inner periphery thereof delimiting a bore extended therethrough and receiving the first end of the rod. Further, an orifice is extended radially through the sleeve into the bore. The stopper is movably engaged with and disposed at a fixed predetermined position on the positioning track. The detent is engaged between the rod and the sleeve and movably engaged in the recess and the orifice. The biasing member is disposed between the sleeve and the stopper. The sleeve is operably movable against the biasing member to a first position with the detent partially extended out of the orifice and disposed on the first contact section of the recess, and a second position with the detent not extended out of the orifice and disposed on the second contact section of the recess.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an object of the present invention to provide an extension bar that can engage a driving member with a pneumatic tool securely, so that the driving member will not disengage from the extension bar inadvertently when it is quickly driven by the pneumatic tool.

Other objects, advantages, and new features of the present invention will become apparent from the following detailed description of the invention when considered in conjunction with the accompanied drawings.

DETAILED DESCRIPTION OF THE INVENTION

Figure 1:
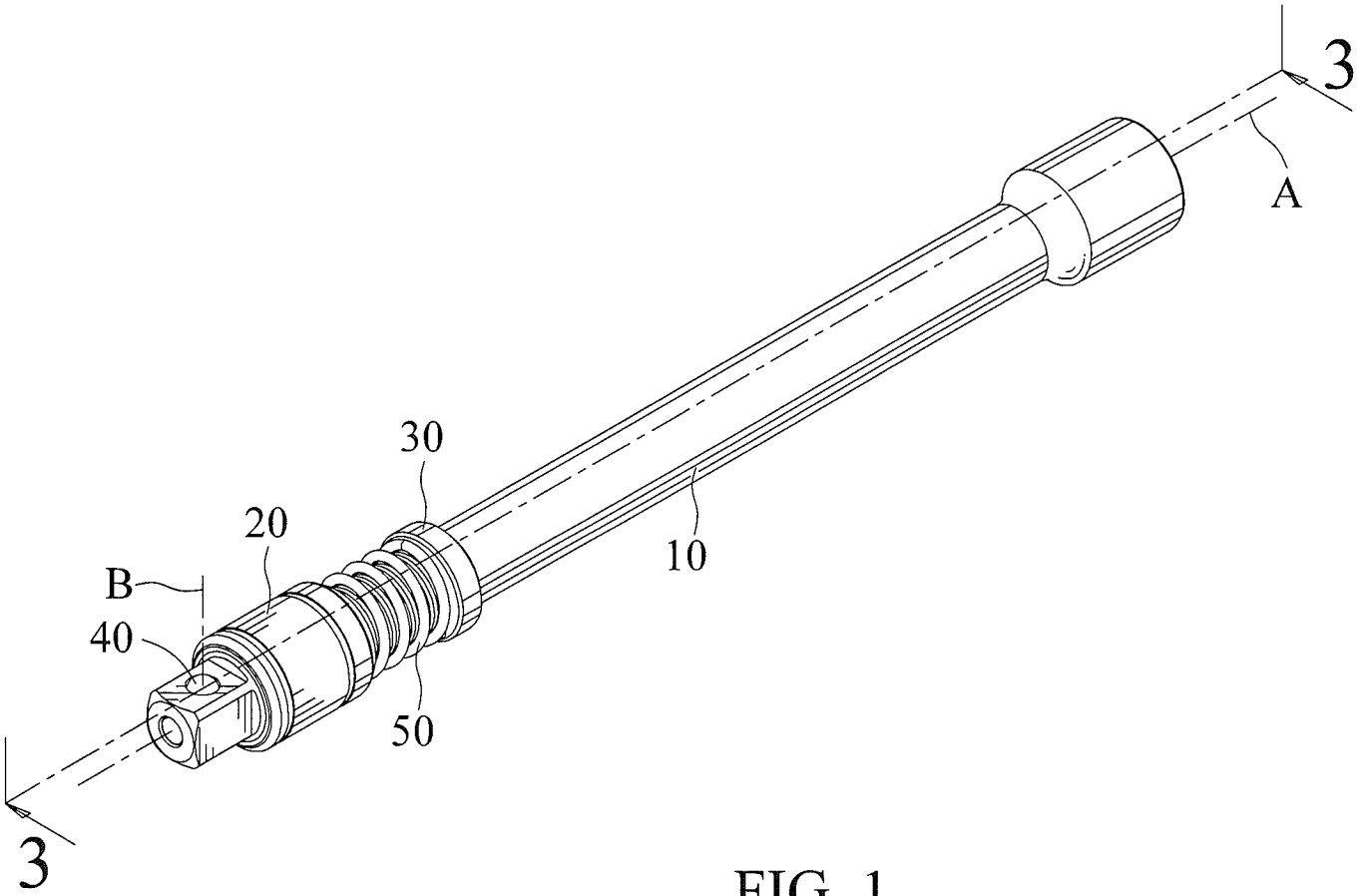
FIG. 1 is a perspective view of an extension bar in accordance with the present invention.
Figure 2:
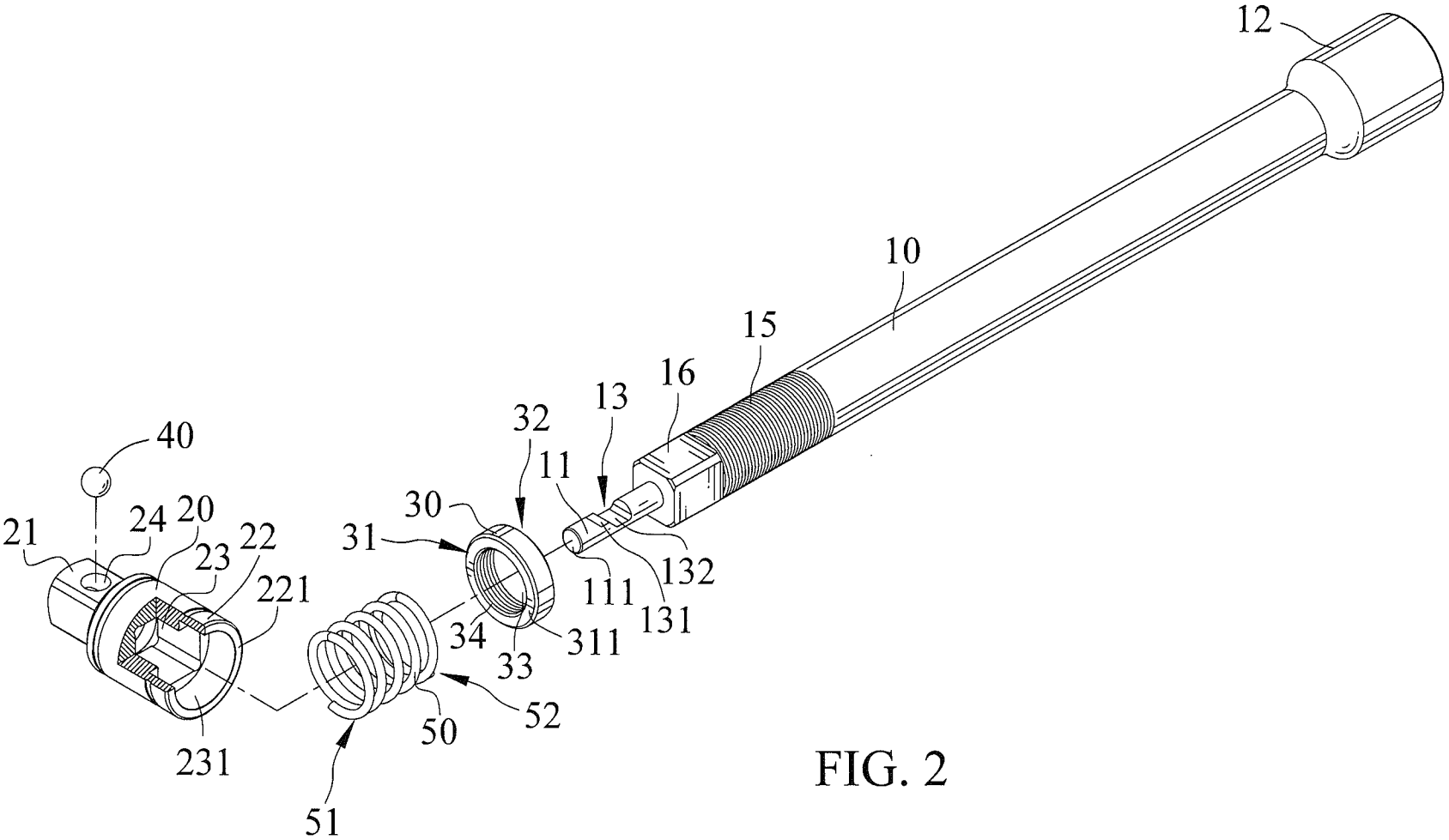
FIG. 2 is an exploded, perspective view of the extension bar of FIG. 1.
Figure 3:
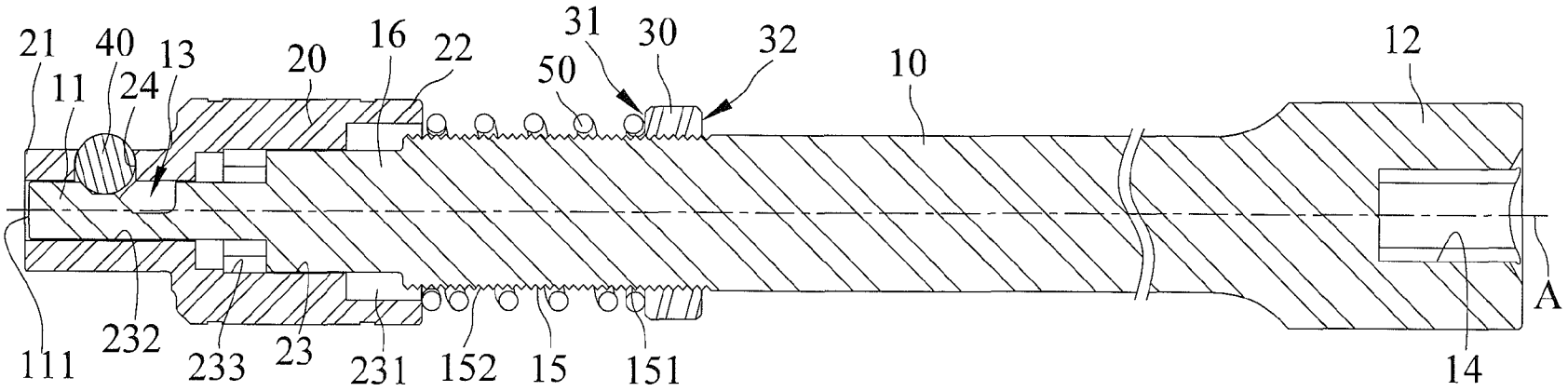
FIG. 3 is a cross-sectional view taken along line 3-3 of FIG. 1.
Figure 4:
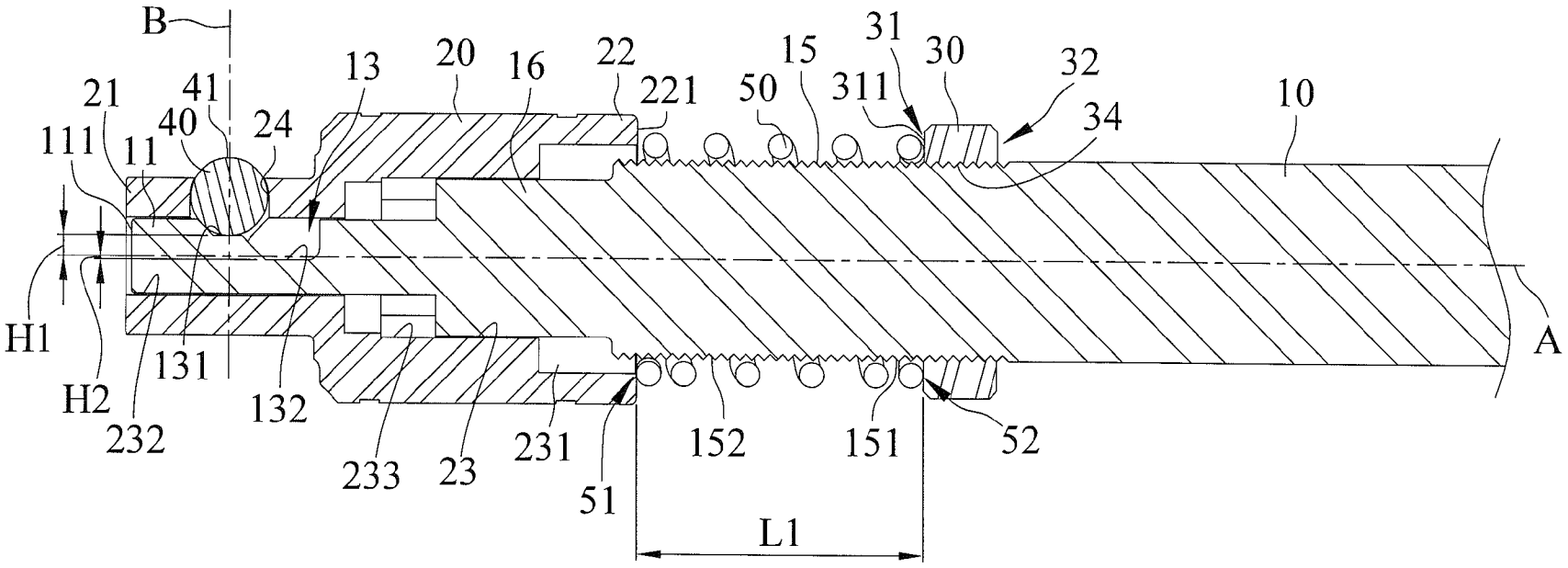
FIG. 4 is a partial view of FIG. 3.
Figure 5:
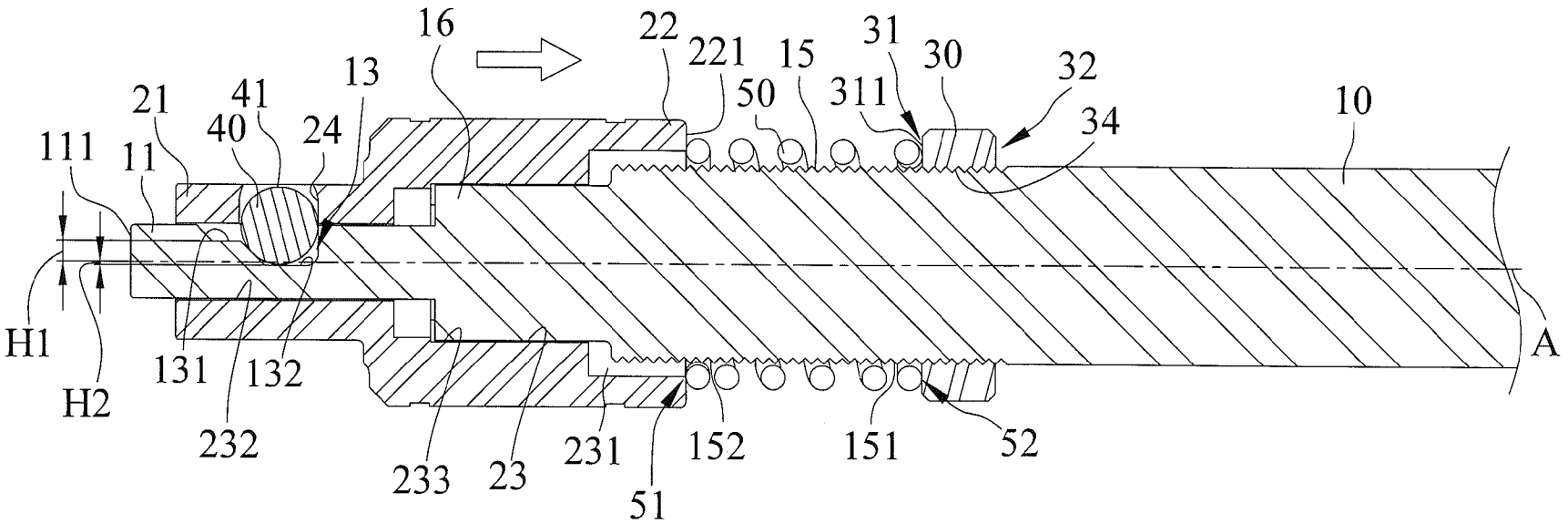
FIG. 5 is an extended cross-sectional view of FIG. 3 and shows the extension bar including a sleeve moved to a position that a detent is not extended out of the sleeve.
Figure 6:
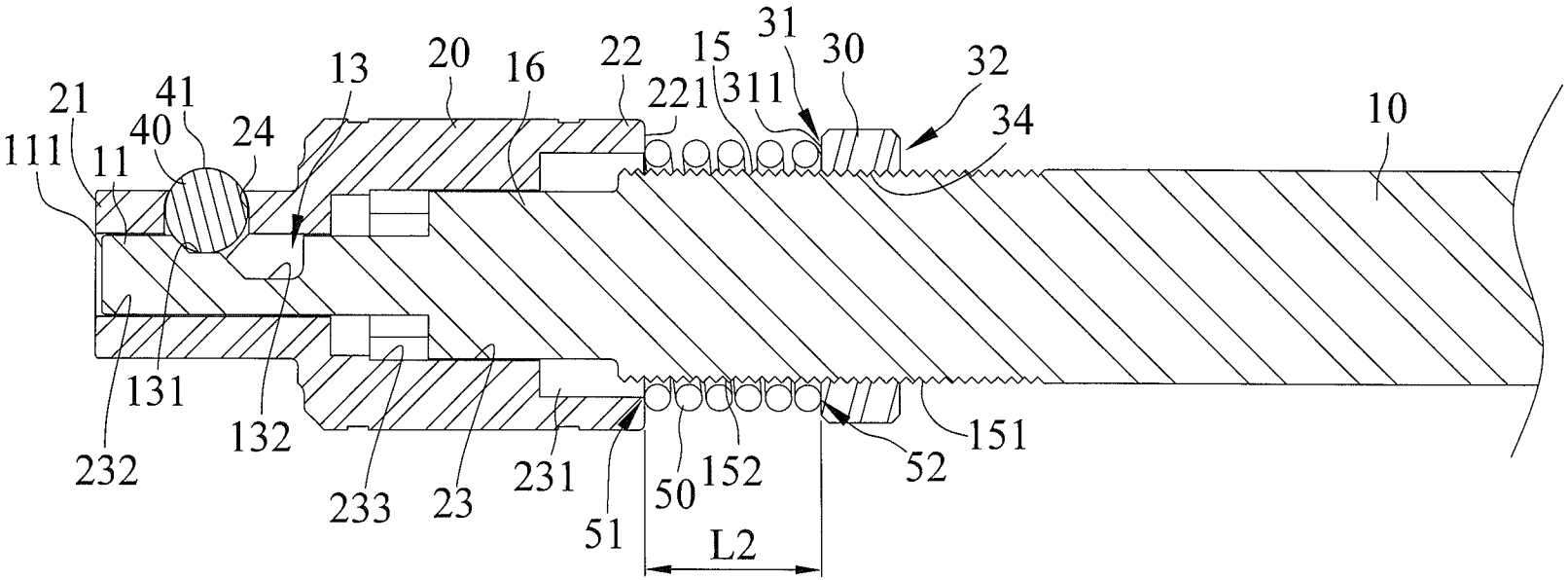
FIG. 6 is an extended cross-sectional view of FIG. 3 and shows the extension bar including a stopper moved to a position that a biasing member tensioned between the stopper and the sleeve is subject to a tension different than that shown in FIG. 3.

FIGS. 1 through 6 show an extension bar in accordance with the present invention. The extension bar is adapted to be used to engage a driving member with a pneumatic tool. The extension bar includes a rod 10, a sleeve 20, a stopper 30, a detent 40, and a biasing member 50.

The rod 10 is engagable with a pneumatic tool. The rod 10 has a first end 11 and a second end 12 opposite to the first end 11, and extends from the first end 11 to the second end 12 or along a first axis A, which extends longitudinally from the first end 11 to the second end 12 of the rod 10 and represents a center line of the rod 10. The rod 10 includes the first end 11 defining an end surface 111. The rod 10 has an outer periphery thereof including a recess 13 extended thereon. The recess 13 is adjacent to the second end 12 of the rod 10. The recess 13 defines a first contact section 131 and a second contact section 132. The first contact section 131 has a first depth from the outer periphery of the rod 10. The second contact section 132 has a second depth from the outer periphery of the rod 10. The second depth is greater than the first depth. The first and second contact sections 131 and 132 of the recess 13 are respectively at first and second perpendicular distances H1 and H2 from the first axis A, and the first perpendicular distance H1 is greater than the second perpendicular distance H2. The first and second contact sections 131 and 132 are extended along the first axis A. The second contact section 132 is disposed after the first contact section 131 longitudinally. The second contact section 132 is extended from the first contact section 131. The rod 10 includes an engaging structure 14 for joining with the pneumatic tool. The engaging structure 14 is extended on the second end 12 of the rod 10. The engaging structure 14 is in the form of a slot. The rod 10 has the outer periphery thereof including a positioning track 15 extended thereon. The positioning track 15 is disposed between the first and second ends 11 and 12 of the rod 10. The positioning track 15 is in the form of an external thread. The positioning track 15 has a first end 151 and a second end 152 and extends from the first end 151 to the second end 152. The rod 10 has a shoulder 16. The rod 10 defines a first extension extended from the shoulder 16 to the first end 11 thereof and includes the recess 13 extended on the extension, and the first extension has a cross section smaller than a cross section of the shoulder 16. The rod 10 also defines a second extension extended from the shoulder 16 to the second end thereof and includes the positioning track 15 extended thereon. The second extension has a circular cross section.

The sleeve 20 is slidably mounted on the rod 10 and is movable along the first axis A. The sleeve 20 has a first end 21 and a second end 22 opposite to the first end 21, and extends from the first end 21 to the second end 22. The sleeve 20 has an inner periphery thereof delimiting a bore 23, and the first end 11 of the rod 10 is engagable in the bore 23. The bore 23 is extended from the first end 21 to the second end 22 of the sleeve 20 and therethrough. The sleeve 20 includes an orifice 24 extended radially therethrough into the bore 23 and along a second axis B. The sleeve 20 is prevented from rotating with respect to the rod 10. The sleeve 20 includes the bore 23 including a section receiving the shoulder 16. The shoulder 16 and the section of the bore 23 receiving the shoulder 16 have corresponding shapes, and have non-circular cross sections. The section of the bore 23 that receives the shoulder 16 defines a first section 231 of the bore 23. The bore 23 defines a second section 232 and a third section 233, and the second section 232 is extended between the first and third sections 231 and 233. The first extension of the rod 10 is engaged in third section 233 of the bore 23. The first extension of the rod 10 and the third section of the bore 23 have corresponding shapes, and have circular cross sections.

The stopper 30 is movably engaged with and disposed at a fixed predetermined position on the positioning track 15. The stopper 30 is movable between the first and second ends 151 and 152 of the positioning track 15. The stopper 30 has a first end 31 and a second end 32 opposite to the first end 31 and includes a hole 33 extended therethrough from the first end 31 to the second end 32. The stopper 30 includes an inner periphery thereof delimiting the hole 33. The rod 10 inserts through the stopper 30 through the hole 33. The stopper 30 and the rod 10 are in thread engagement. The stopper 30 includes the inner periphery thereof forming an inner thread 34. The inner thread 34 of the stopper 30 is engaged with the outer thread of the positioning track 15 when the stopper 30 is engaged with the rod 10.

The detent 40 is engaged between the rod 10 and the sleeve 20. The detent 40 is movably engaged in the recess 13 and the orifice 24 of the sleeve 20. The detent 40 is movable to a first position partially extended out of the orifice 24 and disposed on the first contact section 131 of the recess 13, and a second position not extended out of the orifice 24 and disposed on the second contact section 132 of the recess 13. A portion 41 of the detent 40 is extended out of the orifice 24 when the detent 40 is partially extended out of the orifice 24. The detent 40 is movable to the first and second positions by operating the sleeve 20 relative to the rod 10. The sleeve 20 is operably movable to a first position that the detent 40 is partially extended out of the orifice 24 and disposed on the first contact section 131 of the recess 13, and a second position that the detent 40 is not extended out of the orifice 24 and disposed on the second contact section 132 of the recess 13. The detent 40 has a spherical shape.

Additionally, the sleeve 20 is moved away from the end surface 111 of the rod 10 as it is moved from the first position to the second position thereof.

The biasing member 50 is disposed between the sleeve 20 and the stopper 30. Therefore, the sleeve 20 is moved against the biasing member 50. The biasing member 50 extends longitudinally at a first length L1 when the sleeve 20 is in the first position thereof and at a second length L2 when the sleeve is in the second position thereof, respectively. The first length L1 is greater than the second length L2. The biasing member 50 is abutted against the sleeve 20 and the stopper 30. The biasing member 50 has a first end 51 stopped by the sleeve 20 and a second end 52 opposite to the first end stopped by the stopper 30. The sleeve 20 includes the second end 22 thereof forming a first stop edge 221 against which the first end 51 of the biasing member 50 is abutted. The stopper 30 includes the first end 31 thereof forming a second stop edge 311 against which the second end of the biasing member 50 is abutted. The biasing member 50 is not received in the bore 23 of the sleeve 20. The biasing member 50 is circumferentially extended along the outer periphery of the rod 10. The biasing member 50 has a shape including a plurality of coaxial loops.

The extension bar is releasably engagable with a driving member which has an inner periphery thereof delimiting a hole which can receive the second end 12 of the rod 10 and cling on the sleeve 20 securely by the detent 40. The detent 40 is partially extended out of the orifice 24 of the sleeve 20 and abutted against the inner periphery of the driving member when the driving member and the extension bar are securely engaged together. The detent 40 is not extended out of the orifice 24 of the sleeve 20 and will allow the driving member to disengage from the extension bar.

In view of the forgoing, the detent 40 engaged between the rod 10 and the sleeve 20 is movable to the first position which extends out of the sleeve 20 and is disposed on the first contact section 131 of the recess 13, and to the second position which does not extend out of the sleeve 20 and is disposed on the second contact section 132 of the recess 13. The second contact section 132 is deeper from the outer periphery of the rod 10 than the first contact section 131. The sleeve 20 is slidably mounted on the rod 10 and biased by the biasing member 50. The biasing member 50 is disposed between the sleeve 20 and the stopper 30. A resilient return force from the biasing member 50 can be adjusted by changing the position of the stopper 30 relative to the sleeve 20. With the sleeve 20 and the stopper 30 further disposed apart from each other, a user can operably move the sleeve 20 against the biasing member 50 from the first position to the second position thereof with less effort. Therefore, if a user would like to disengage the driving member from the extension bar in a quick manner, the stopper 30 should be moved further apart from the sleeve 20. However, if the user wishes to prevent the sleeve 20 from moving from the first position to the second position thereof inadvertently, the stopper 30 should be moved closer to the sleeve 20.

While the specific embodiments have been illustrated and described, numerous modifications come to mind without significantly departing from the spirit of invention, and the scope of invention is only limited by the scope of the accompanying claims.

What is claimed is:

1. An extension bar adapted to releasably engage a driving member with a pneumatic tool in a quick manner, comprising:

a rod having a first end and a second end opposite to the first end adapted to engage with a pneumatic tool, with the rod extending from the first end to the second end along a first axis, with the rod having an outer periphery including a recess and a threaded positioning track extended thereon, along the first axis, with the recess defining a first contact section and a second contact section disposed after the first contact section longitudinally along the first axis;

a sleeve slidably mounted on the rod along the first axis and having an inner periphery thereof delimiting a bore extended therethrough receiving the first end of the rod and including an orifice extended radially therethrough into the bore;

a stopper threadedly engaged relative to the rod along the first axis and removably fixed at a fixed predetermined position along the first axis on the positioning track;

a detent engaged between the rod and the sleeve and movably engaged in the recess and the orifice; and a biasing member engaging the sleeve and the stopper such that the biasing member abuts an end face of the sleeve and wherein the biasing member is not received inside the sleeve, wherein a resilient force from the biasing member between the rod and the sleeve is variable in response to the fixed predetermined position of the stopper relative to the rod along the first axis;

wherein the sleeve is operably movable against the biasing member to a first position with the detent partially extended out of the orifice and disposed on the first contact section of the recess, and a second position with the detent disposed on the second contact section of the recess.

2. The extension bar as claimed in claim 1, wherein the first contact section has a first depth from the outer periphery of the rod, and the second contact section has a second depth from the outer periphery of the rod, with the second depth greater than the first depth.

3. The extension bar as claimed in claim 1, wherein the biasing member is circumferentially extended along the outer periphery of the rod.

4. The extension bar as claimed in claim 3, wherein the biasing member has a shape including a plurality of coaxial loops.

5. The extension bar as claimed in claim 1, wherein the biasing member extends longitudinally at a first length when the sleeve is in the first position thereof and at a second length when the sleeve is in the second position thereof, with the first length greater than the second length.

6. The extension bar as claimed in claim 1, wherein the rod has a shoulder, and wherein the sleeve includes the bore including a section receiving the shoulder, with the shoulder and the section of the bore receiving the shoulder having corresponding shapes of non-circular cross sections.

7. The extension bar as claimed in claim 6, wherein the rod defines an extension extended from the shoulder to the first end thereof and includes the recess extended on the extension, and wherein the extension has a cross section smaller than a cross section of the shoulder.

* * * * *